US009478163B2

(12) United States Patent
Lee et al.

(10) Patent No.: US 9,478,163 B2
(45) Date of Patent: Oct. 25, 2016

(54) ORGANIC LIGHT EMITTING DIODE DISPLAY AND METHOD OF DRIVING THE SAME

(71) Applicant: SAMSUNG DISPLAY CO., LTD., Yongin, Gyeonggi-Do (KR)

(72) Inventors: Gil-Jae Lee, Yongin (KR); Seo-Hyeong Yang, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 262 days.

(21) Appl. No.: 14/013,472

(22) Filed: Aug. 29, 2013

(65) Prior Publication Data

US 2014/0307002 A1 Oct. 16, 2014

(30) Foreign Application Priority Data

Apr. 16, 2013 (KR) ..... 10-2013-0041878

(51) Int. Cl.
*G09G 3/20* (2006.01)
*G09G 3/32* (2016.01)

(52) U.S. Cl.
CPC ..... *G09G 3/2096* (2013.01); *G09G 3/3233* (2013.01); *G09G 3/3291* (2013.01); *G09G 2300/0842* (2013.01); *G09G 2320/0233* (2013.01); *G09G 2320/0285* (2013.01); *G09G 2320/0673* (2013.01); *G09G 2370/08* (2013.01)

(58) Field of Classification Search
CPC ..... G09G 3/3258; G09G 3/2096; G09G 3/3233; G09G 3/3291; G09G 2300/0842; G09G 2320/0233; G09G 2320/0285; G09G 2320/0673; G09G 2370/08
See application file for complete search history.

(56) References Cited

U.S. PATENT DOCUMENTS

| | | | | |
|---|---|---|---|---|
| 7,573,468 | B2 | 8/2009 | Pugibet et al. | |
| 2002/0097208 | A1* | 7/2002 | Hashimoto | 345/87 |
| 2003/0103162 | A1 | 6/2003 | Sano et al. | |
| 2006/0290619 | A1 | 12/2006 | Lee et al. | |
| 2007/0008251 | A1* | 1/2007 | Kohno | G09G 3/3233 345/76 |
| 2008/0074362 | A1* | 3/2008 | Ogura | 345/77 |
| 2009/0115707 | A1* | 5/2009 | Park | G09G 3/3233 345/76 |
| 2010/0123739 | A1* | 5/2010 | Kim et al. | 345/690 |
| 2010/0289827 | A1 | 11/2010 | Chen | |

FOREIGN PATENT DOCUMENTS

| | | | |
|---|---|---|---|
| KR | 10-2009-0117228 | A | 11/2009 |
| KR | 10-2012-0028007 | A | 3/2012 |
| KR | 10-2012-0055895 | A | 6/2012 |

* cited by examiner

*Primary Examiner* — LaTanya Bibbins
(74) *Attorney, Agent, or Firm* — Lee & Morse, P.C.

(57) ABSTRACT

An organic light emitting diode (OLED) display and a method of driving the same are provided. The OLED display includes a display panel including data lines, scan lines, and pixels that are connected to a corresponding data line and a corresponding scan line; a signal controller that generates display gamma control data corresponding to a display grayscale of an image source signal according to previously stored gamma curve information and that generates offset gamma control data corresponding to a position of each pixel according to threshold voltage deviation information; a scan driver that supplies scan signals to the scan lines; and a data driver that generates data signals according to the display gamma control data and the offset gamma control data and that supplies signals to the data lines.

11 Claims, 9 Drawing Sheets

(a)

(b)

ORGANIC LIGHT EMITTING DIODE DISPLAY AND METHOD OF DRIVING THE SAME

CROSS-REFERENCE TO RELATED APPLICATION

Korean Patent Application No. 10-2013-0041878 filed on Apr. 16, 2013, in the Korean Intellectual Property Office, and entitled: "ORGANIC LIGHT EMITTING DIODE DISPLAY AND METHOD OF DRIVING THE SAME," is incorporated by reference herein in its entirety.

BACKGROUND

1. Field

Embodiments relate to an organic light emitting diode (OLED) display and a method of driving the same.

2. Description of the Related Art

Display devices are used as a display device of a portable information terminal such as a personal computer, a mobile phone, and a personal digital assistant (PDA) and a monitor of various information devices and have been known as an a liquid crystal display (LCD) using a liquid crystal panel, an OLED display using an organic light emitting element, and a plasma display panel (PDP) using a plasma panel. In the display devices, the OLED display having excellent light emitting efficiency, luminance, and viewing angle and a fast response speed has been in the spotlight.

The OLED display disposes a plurality of pixels in a matrix format on a substrate to form the pixels in a display area, and connects a scan line and a data line to each pixel to selectively apply a data signal to the pixel, thereby displaying an image. Such an OLED display may be classified into a passive matrix OLED display that forms to cross a positive electrode and a negative electrode and that selects and drives a line and an active matrix OLED display that maintains a data signal that is switched by a switching transistor with a capacitor and that applies the data signal to a driving transistor and that thus controls a current flowing to an OLED.

However, in the active matrix OLED display, due to a process errors, threshold voltage Vth characteristics of a driving transistor may be differently displayed according to a position of a display area. In this case, even if the same data signal is applied to a driving transistor of each pixel, a difference exists in a current flowing to the OLED, and resultantly each pixel emits light with different luminance.

That is, when a threshold voltage deviation of a driving transistor occurs between pixels within a display panel, a uniformity failure and a stain of luminance are viewed. Moreover, when a deviation of a threshold voltage of such a driving transistor occurs between display panels, a gray voltage of different black levels or white levels occurs according to a panel and thus a characteristic of luminance and a contrast ratio of each display panel are not uniform. In order to solve this, an optical compensation method of correcting a data signal according to gamma characteristics of the OLED display is applied.

The above information disclosed in this Background section is only for enhancement of understanding of the background and therefore it may contain information that does not form the prior art that is already known in this country to a person of ordinary skill in the art.

SUMMARY

An exemplary embodiment provides an organic light emitting diode (OLED) display including: a display panel including a plurality of data lines, a plurality of scan lines, and a plurality of pixels that are connected to a corresponding data line and a corresponding scan line; a signal controller that generates display gamma control data corresponding to a display grayscale of an image source signal according to previously stored gamma curve information and that generates offset gamma control data corresponding to a position of each of the plurality of pixels according to threshold voltage deviation information; a scan driver that supplies a plurality of scan signals to the plurality of scan lines; and a data driver that generates a plurality of data signals according to the display gamma control data and the offset gamma control data and that supplies the plurality of data signals to the plurality of data lines.

The data driver may select one of a plurality of display gray voltages according to the display gamma control data, select one of a plurality of offset gray voltages according to the offset gamma control data, and add the selected display gray voltage and offset gray voltage to generate a data voltage corresponding to each of the plurality of data signals.

The plurality of offset gray voltages may be a voltage level in which a threshold voltage deviation of each of the plurality of pixels is reflected to a gray voltage corresponding to a black grayscale.

The data driver may include an offset gray voltage generator that generates the plurality of offset gray voltages; a display gray voltage generator that generates the plurality of display gray voltages; a first mux that selects one of the plurality of display gray voltages according to the display gamma control data; a second mux that selects one of the plurality of offset gray voltages according to the offset gamma control data; first and second buffers that buffer an output of the first and second muxes; and an adder that outputs the data voltage by adding outputs of the first and second buffers.

The data driver may include an amplifier that amplifies an output of the first mux. The signal controller may divide the image source signal into a first image source signal of a high grayscale segment and a second image source signal of a low grayscale segment, and the display gamma control data may include first display gamma control data corresponding to the first image source signal and second display gamma control data corresponding to the second image source signal.

The data driver may select one of a plurality of first display gray voltages according to the first display gamma control data, select one of a plurality of second display gray voltages according to the second display gamma control data, select one of a plurality of offset gray voltages according to the offset gamma control data, add the selected second display gray voltage and offset gray voltage, and add the first display gray voltage to the added second display gray voltage and offset gray voltage to output the data voltage.

Embodiment provide a method of driving an OLED display including a display panel including a plurality of data lines, a plurality of scan lines, and a plurality of pixels that are connected to a corresponding data line and a corresponding scan line, a scan driver that supplies a plurality of scan signals to the plurality of scan lines, and a data driver that supplies a plurality of data signals to the plurality of data lines, the method including: generating display gamma control data corresponding to a display grayscale of an image source signal according to previously stored gamma curve information; generating offset gamma control data corresponding to a position of each of the plurality of pixels according to threshold voltage deviation information;

and generating the plurality of data signals according to the display gamma control data and the offset gamma control data.

Generating the plurality of data signals may include selecting one of a plurality of display gray voltages according to the display gamma control data; selecting one of a plurality of offset gray voltages according to the offset gamma control data; and generating a data voltage by adding the selected display gray voltage and offset gamma control data.

Generating the plurality of data signals may include generating the plurality of offset voltages so that the plurality of offset gray voltages have a voltage level in which a threshold voltage deviation of each of the plurality of pixels is reflected to a gray voltage corresponding to a black grayscale.

Generating the plurality of data signals may include amplifying the selected display gray voltage. The generating of display gamma control data may include dividing the image source signal into a first image source signal of a high grayscale segment and a second image source signal of a low grayscale segment; and generating first display gamma control data corresponding to the first image source signal and second display gamma control data corresponding to the second image source signal.

Generating of the plurality of data signals may include selecting one of a plurality of first display gray voltages according to the first display gamma control data; selecting one of a plurality of second display gray voltages according to the second display gray voltage; selecting one of a plurality of offset gray voltages according to the offset gamma control data and adding the selected second display gray voltage and offset gray voltage; and outputting a data voltage by adding the first display gray voltage to the added second display gray voltage and offset gray voltage.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
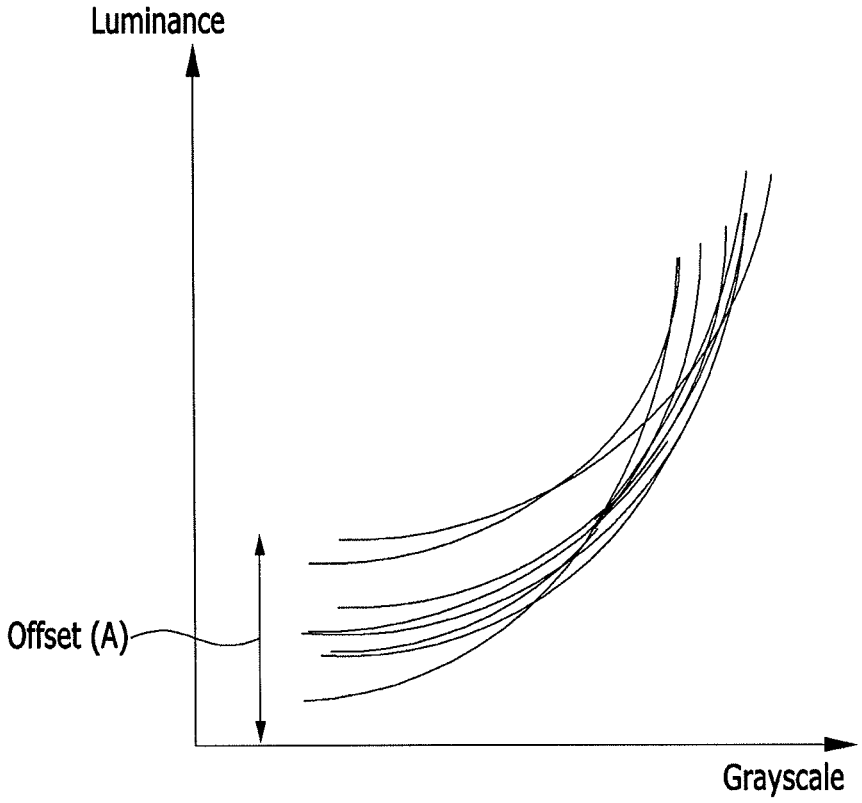
FIG. 1 illustrates a graph of a general gamma curve.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Figure 2:
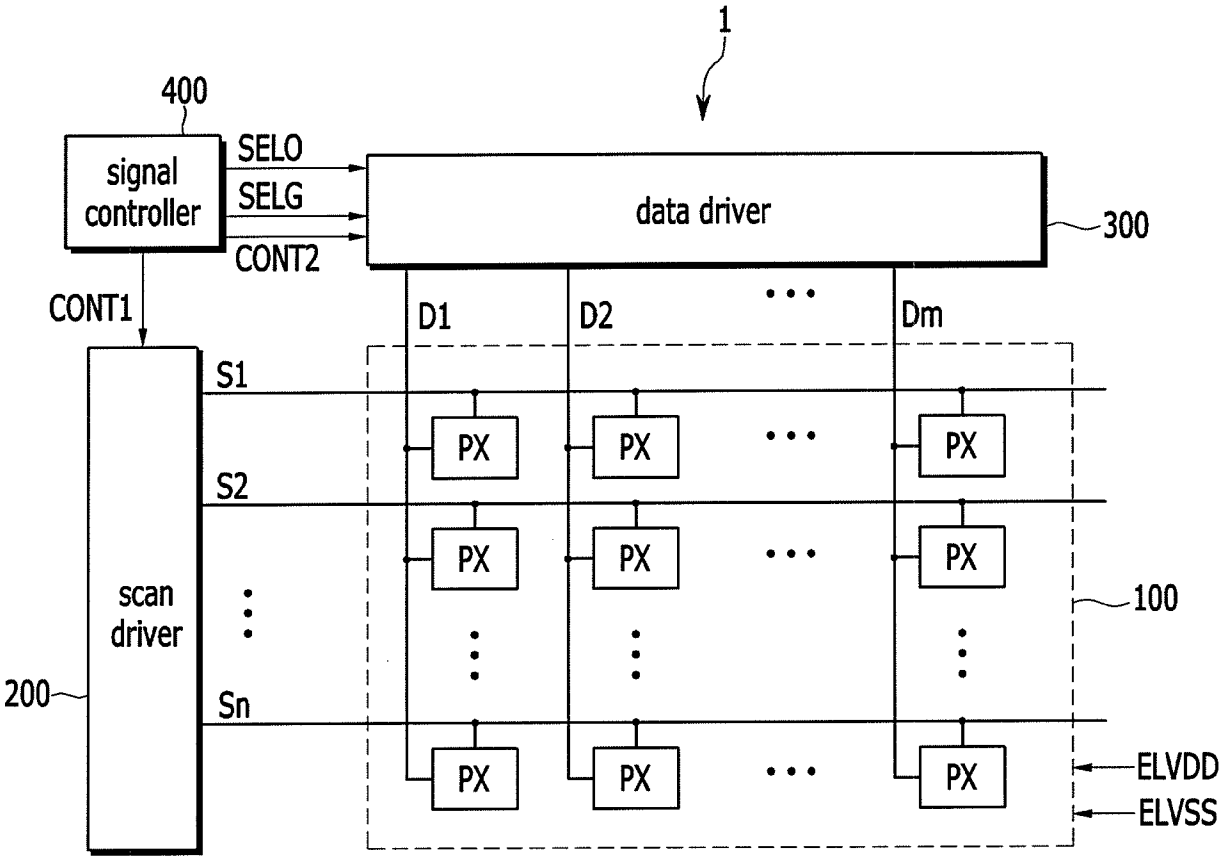
FIG. 2 illustrates a diagram of an OLED display according to an exemplary embodiment.

FIG. 2 illustrates a diagram of an OLED display according to an exemplary embodiment. Referring to FIG. 2, an OLED display 1 according to an exemplary embodiment includes a display panel 100, a scan driver 200, a data driver 300, and a signal controller 400. The display panel 100 is a display area including a plurality of pixels PX, and in the display panel 100, a plurality of scan lines that transfer a plurality of scan signals S1-Sn, a plurality of data lines that transfer a plurality of data signals D1-Dm, and a plurality of wires that apply a first driving voltage ELVDD and a second driving voltage ELVSS are formed.

The plurality of pixels PX are each connected to a corresponding scan line, a corresponding data line, a first driving voltage ELVDD applied line, and a second driving voltage ELVSS applied line. Further, the plurality of pixels PX each may include a red subpixel R that emits red light, a green subpixel G that emits green light, and a blue subpixel B that emits blue light.

The scan driver 200 generates a plurality of scan signals S1-Sn according to a first driving control signal CONT1 and transfers the plurality of scan signals S1-Sn to a corresponding scan line. The data driver 300 generates a plurality of data signals D1-Dm according to offset gamma control data SELO and display gamma control data SELG and transfers a plurality of data signals D1-Dm that are generated according to a second driving control signal CONT2 to a corresponding plurality of data lines.

Specifically, the data driver 300 generates a plurality of display gray voltages VG and a plurality of offset gray voltages VOFFS. The data driver 300 selects one of the plurality of display gray voltages VG according to the display gamma control data SELG and selects one of the plurality of offset gray voltages VOFFS according to the offset gamma control data SELO.

The data driver 300 adds the selected display gray voltage VG and offset gray voltage VOFFS and generates data voltages Vdata1-Vdatam corresponding to each of the plurality of data signals D1-Dm.

Here, the data driver 300 divides a threshold voltage deviation between driving transistors (TR2 of FIG. 3) that are included in each of a plurality of pixels PX into a plurality of steps according to a predetermined range and generates a plurality of offset gray voltages VOFFS corresponding to each of a plurality of steps based on a gray voltage corresponding to an offset grayscale.

In an exemplary embodiment, when an image source signal IS is 8 bit data, it is defined that an offset grayscale is 0 grayscale, i.e., a full black grayscale and a display grayscale is 1-255 grayscale. An exemplary embodiment is not limited thereto and the offset grayscale may include 255 grayscales, i.e., a full white grayscale.

The signal controller 400 receives an input of input data IDAT from the outside and separates an image source signal IS and a command signal SC from the input data IDAT. The signal controller 400 generates display gamma control data SELG corresponding to a displayed grayscale according to previously stored gamma curve information and generates offset gamma control data SELO corresponding to a position of each of the plurality of pixels PX according to threshold voltage deviation information. The signal controller 400 generates first and second driving control signals CONT1 and CONT2 according to the command signal SC.

Here, gamma curve information and threshold voltage deviation information is each divided into and stored on red, green, and blue subpixel basis and may be previously stored at a non-volatile memory, for example, a read only memory (ROM). In this case, the display gamma control data SELG and the offset gamma control data SELO may each be generated on red, green, and blue subpixel basis.

Figure 3:
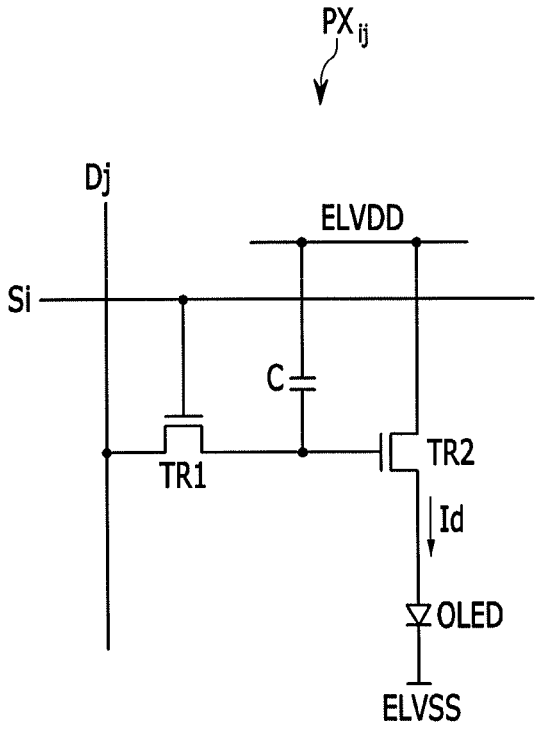
FIG. 3 illustrates an equivalent circuit diagram of a pixel according to an exemplary embodiment.

FIG. 3 is an equivalent circuit diagram of a pixel PX according to an exemplary embodiment. Referring to FIG. 3, a pixel PXij that is connected to an i-th scan line in which an i-th scan signal Si is transferred and a j-th data line in which a j-th data signal Dj is transferred according to an exemplary embodiment includes a switching transistor TR1, a driving transistor TR2, a capacitor C, and an OLED.

The switching transistor TR1 includes a gate electrode connected to the i-th scanine, a source electrode that is connected to the j-th data line, and a drain electrode connected to the gate electrode of the driving transistor TR2.

The driving transistor TR2 includes a source electrode connected to a wire to which a first driving voltage ELVDD is applied, a drain electrode connected to an anode electrode of the OLED, and a gate electrode to which a voltage corresponding to an j-th data signal Dj is transferred during a period in which the switching transistor TR1 is turned on.

The capacitor C is connected between a gate electrode and a source electrode of the driving transistor TR2. A cathode electrode of the OLED is connected to a wire to which the second driving voltage ELVSS is applied.

At the pixel PXij having such a structure, when the switching transistor TR1 is turned on by the scan signal Si, the data signal Dj is transferred to a gate electrode of the driving transistor TR2. A voltage difference between the gate electrode and the source electrode of the driving transistor TR2 is maintained by the capacitor C, and a driving current flow to the driving transistor TR2. An OLED emits light according to the driving current.

An exemplary embodiment is not limited thereto, and the pixel PXij of FIG. 3 is an example of a pixel of the display device, a pixel of another form may be used.

Figure 4:
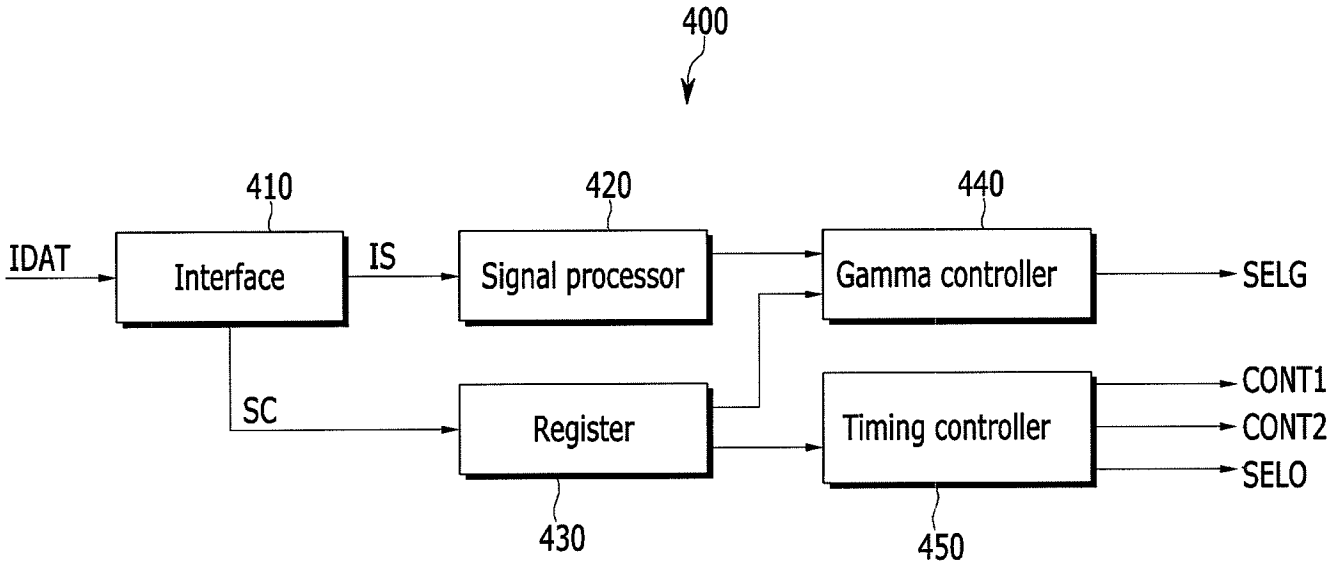
FIG. 4 illustrates a block diagram of a signal controller of FIG. 2.

FIG. 4 is a block diagram of the signal controller 400 of FIG. 2. Referring to FIG. 4, the signal controller 400 according to an exemplary embodiment includes an interface 410, a signal processor 420, a register 430, a gamma controller 440, and a timing controller 450.

The interface 410 receives input data IDAT from the outside, separates the input data IDAT to an image source signal IS and a command signal SC, and transfers the image source signal IS and the command signal SC to the signal processor 420 and the register 430, respectively.

The signal processor 420 processes a signal of the image source signal IS and transfers the signal to the gamma controller 440. The register 430 generates a synchronization signal and an image source control signal according to the command signal SC and transfers the synchronization signal and the image source control signal to the gamma controller 440 and the timing controller 450, respectively.

The synchronization signal includes a horizontal synchronization signal Hsync, a vertical synchronization signal Vsync, and a main clock signal MCLK, and the image source control signal includes information, necessary for displaying an image in the display panel 100, such as address information and driving frequency information of each of the plurality of pixels PX.

The gamma controller 440 generates display gamma control data SELG of n-bits according to previously stored gamma curve information. The timing controller 450 generates offset gamma control data SELO of m-bits according to previously stored threshold voltage deviation information, synchronization signal, and image source control signal. The timing controller 450 outputs first and second driving control signals CONT1 and CONT2 according to a synchronization signal.

Figure 5:
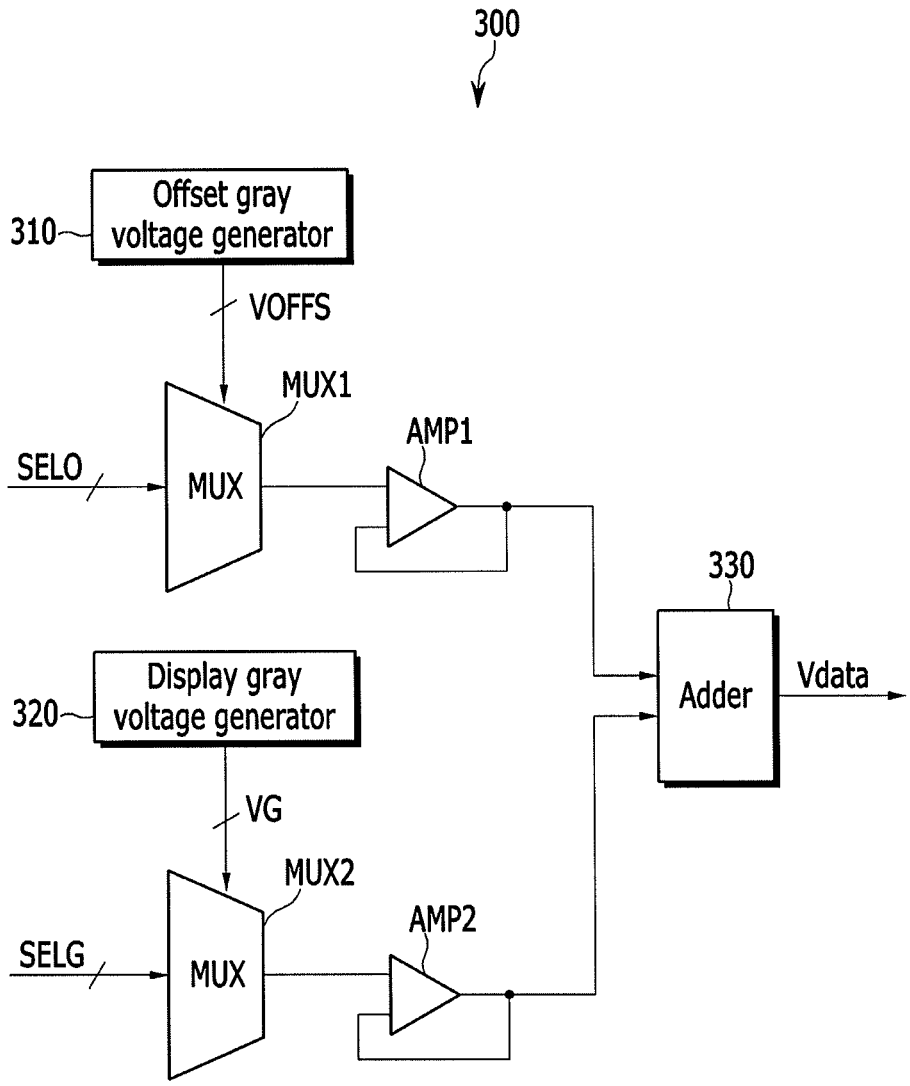
FIG. 5 illustrates a circuit diagram of a data driver according to an exemplary embodiment.

FIG. 5 illustrates a circuit diagram of the data driver 300 according to an exemplary embodiment. Referring to FIG. 5, the data driver 300 according to an exemplary embodiment includes an offset gray voltage generator 310, a display gray voltage generator 320, first and second muxes MUX1 and MUX2, first and second buffers AMP1 and AMP2, and an adder 330. Here, the first and second muxes MUX1 and MUX2, the first and second buffers AMP1 and AMP2, and the adder 330 may each be disposed to correspond to the number of data lines.

The offset gray voltage generator 310 generates a plurality of offset gray voltages VOFFS, and the display gray voltage generator 320 generates a plurality of display gray voltages VG.

The first mux MUX1 selects and outputs one of the plurality of offset gray voltages VOFFS according to offset gamma control data SELO, and the second mux MUX2 selects and outputs one of the plurality of display gray voltages VG according to display gamma control data SELG.

The first buffer AMP1 buffers and outputs an offset gray voltage VOFFS that is output from the first mux MUX1. The second buffer AMP2 buffers and outputs a display gray voltage VG that is output from the second mux MUX2. The adder 330 adds the offset gray voltage VOFFS and the display gray voltage VG and outputs a data voltage Vdata.

Figure 6:
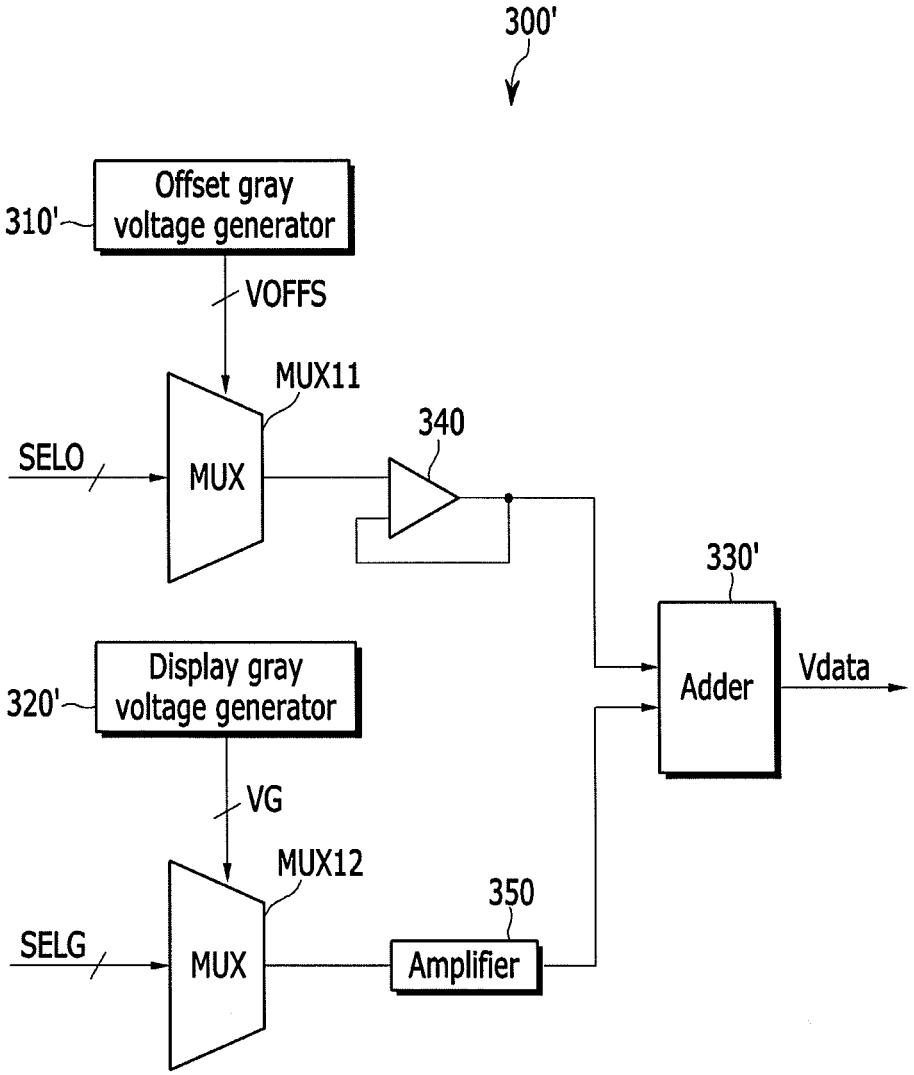
FIG. 6 illustrates a circuit diagram of a data driver according to another exemplary embodiment.

FIG. 6 illustrates a circuit diagram of a data driver 300' according to another exemplary embodiment. Referring to FIG. 6, the data driver 300' according to another exemplary embodiment includes an offset gray voltage generator 310', a display gray voltage generator 320', first and second muxes MUX11 and MUX12, a buffer 340, an amplifier 350, and an adder 330'. The offset voltage generator 310' generates a plurality of offset voltages VOFFS, and the display gray voltage generator 320' generates a plurality of gray voltages VG.

The first mux MUX11 selects and outputs one of a plurality of offset voltage VOFFS according to an offset gamma control data SELO, and the second mux MUX12 selects and outputs one of a plurality of display gray voltages VG according to display gamma control data SELG.

The buffer 340 buffers and outputs an offset gray voltage VOFFS that is output from the first mux MUX11. The amplifier 350 amplifies and outputs a display gray voltage VG that is output from the second mux MUX2 by a preset magnitude.

Figure 7:
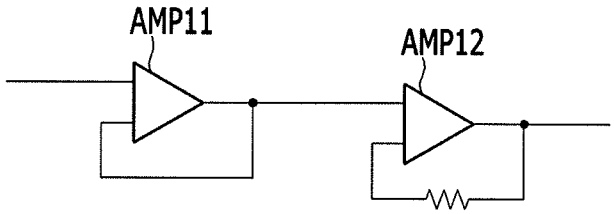
FIG. 7 illustrates a circuit diagram of an amplifier of FIG. 6.
Figure 7:
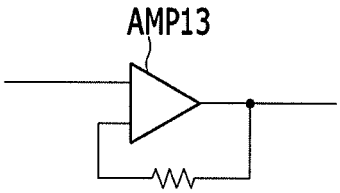

Here, the amplifier 350 may include a buffer AMP11 and a calculation amplifier AMP12 that are connected in a multistage, as shown in FIG. 7A, or a calculation amplifier AMP13 that is connected in one stage, as shown in FIG. 7B.

The adder 330' adds the offset gray voltage VOFFS and the display gray voltage VG and outputs a data voltage Vdata. That is, the data driver 300' according to another exemplary embodiment increases a display gray voltage VG by a predetermined level and calculates the increased display gray voltage VG with an offset gray voltage VOFFS, thereby compensating luminance deterioration due to degradation of each of a plurality of pixels PX.

Figure 8:
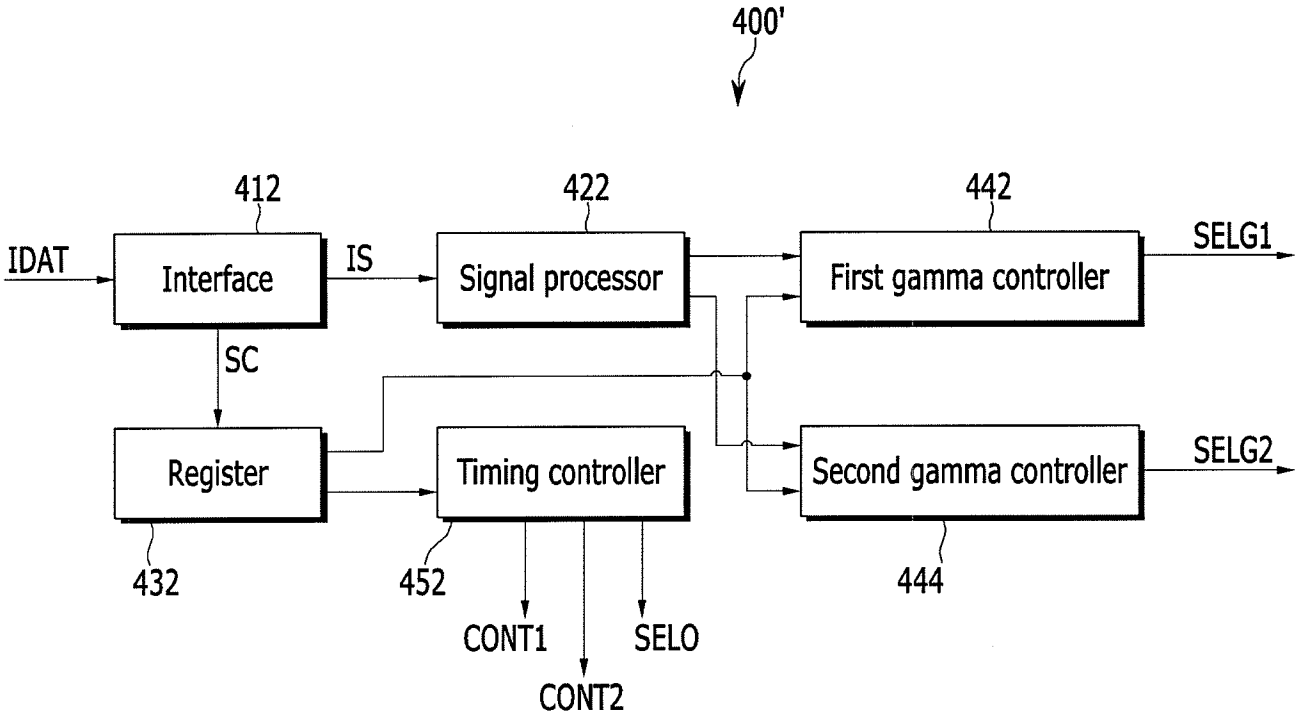
FIG. 8 illustrates a block diagram of a signal controller according to another exemplary embodiment.

FIG. 8 illustrates a block diagram of a signal controller 400' according to another exemplary embodiment. Referring to FIG. 8, the signal controller 400' according to another exemplary embodiment includes an interface 412, a signal processor 422, a register 432, a first gamma controller 442, a second gamma controller 444, and a timing controller 452.

Here, the interface 412 receives input data IDAT from the outside, separates the input data IDAT to an image source signal IS and a command signal SC, and transfers the image source signal IS and the command signal SC to the signal processor 422 and the register 432, respectively.

The signal processor 422 separates a total grayscale segment of the image source signal IS to a high grayscale segment and a low grayscale segment, transfers the image source signal IS of a high grayscale segment to the first gamma controller 442, and transfers the image source signal IS of a low grayscale segment to the second gamma controller 444. For example, when the image source signal IS is data of 8 bits, the low grayscale segment may include 32 grayscales 0-31, and the high grayscale segment may include the remaining 224 grayscales 32-255.

The register 432 generates a synchronization signal and an image source control signal according to the command signal SC and transfers the synchronization signal and the image source control signal to the first and second gamma controllers 442 and 444, respectively. The timing controller 452 generates offset gamma control data SELO of m bits according to previously stored threshold voltage deviation information, synchronization signal, and image source control signal. The timing controller 450 outputs first and second driving control signals CONT1 and CONT2 according to the synchronization signal.

The first gamma controller 442 generates first display gamma control data SELG1 corresponding to the image source signal IS of a low grayscale segment according to gamma curve information. The second gamma controller 444 generates second display gamma control data SELG2 corresponding to the image source signal IS of a high grayscale segment according to previously stored gamma curve information.

That is, in another exemplary embodiment, by dividing a grayscale segment into a high grayscale segment and a low grayscale segment and by controlling gamma thereof, luminance of the low grayscale segment may be subdivided and corrected. Further, when controlling gamma of the low grayscale segment, by reflecting together a threshold voltage deviation of each of a plurality of pixels PX, a luminance difference between the plurality of pixels PX or a luminance difference between panels may be compensated.

Figure 9:
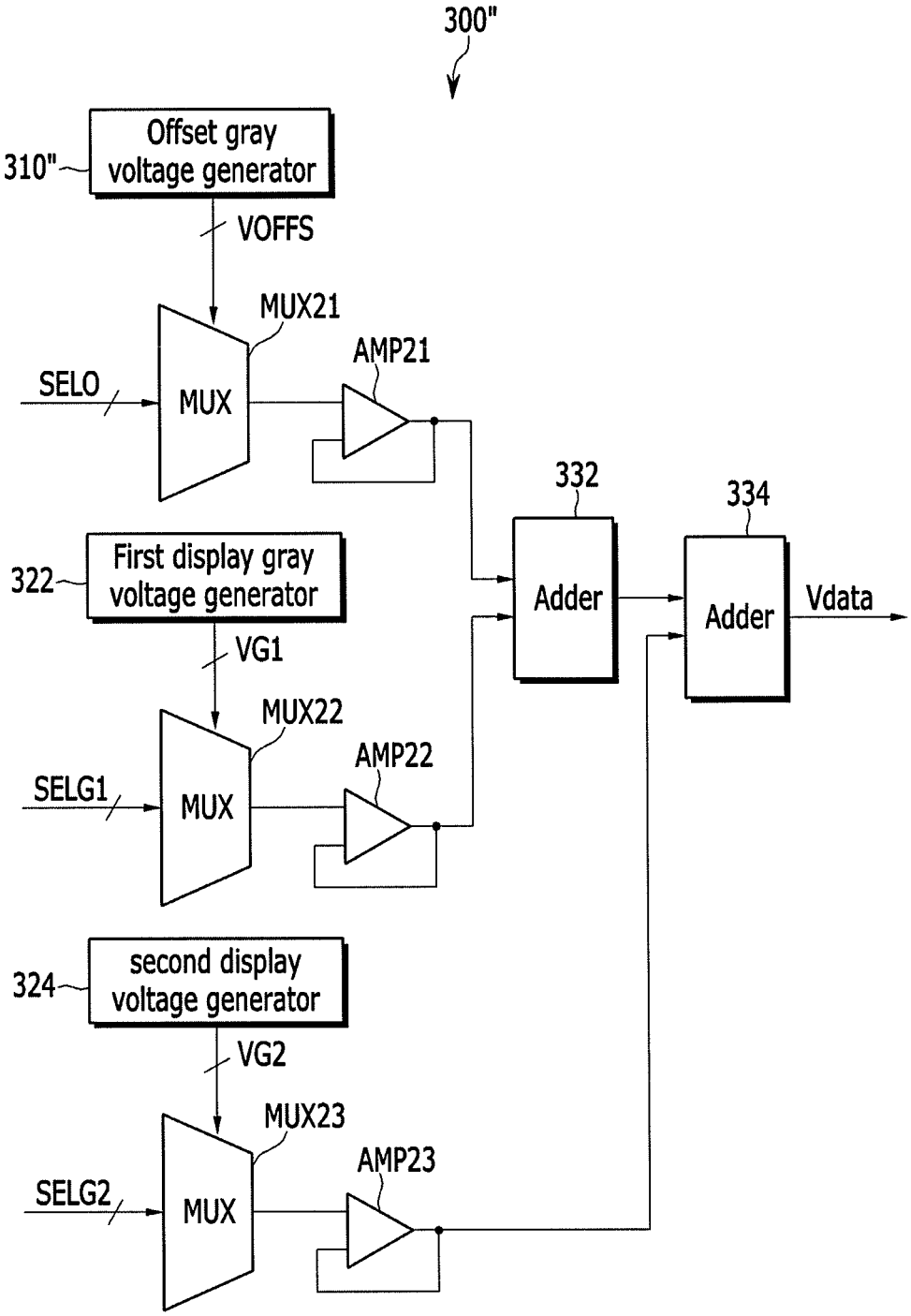
FIG. 9 illustrates a circuit diagram of a data driver according to another exemplary embodiment.

FIG. 9 is a circuit diagram of a data driver 300" according to another exemplary embodiment. Referring to FIG. 9, the data driver 300" according to another exemplary embodiment includes an offset gray voltage generator 310", a first display gray voltage generator 322, a second display gray voltage generator 324, first to third muxes MUX21-MUX23, first to third buffers AMP21-AMP23, and first and second adders 332 and 334.

The offset gray voltage generator 310" generates a plurality of offset gray voltages VOFFS corresponding to each of a plurality of pixels PX, and the first display gray voltage generator 322 generates a plurality of first display gray voltages VG1 corresponding to a low grayscale segment. The second display gray voltage generator 324 generates a plurality of second display gray voltages VG2 corresponding to a high grayscale segment.

The first mux MUX21 selects and outputs one of a plurality of offset gray voltages VOFFS according to offset gamma control data SELO. The second mux MUX22 selects and outputs one of a plurality of second display gray voltage VG2 according to the second display gamma control data SELG2. The third mux MUX23 selects and outputs one of a plurality of first display gray voltages VG1 according to the first display gamma control data SELG1.

The first buffer AMP21 buffers and outputs an offset gray voltage VOFFS that is output from the first mux MUX21. The second buffer AMP22 buffers and outputs the second display gray voltage VG2 that is output from the second mux MUX22. The third buffer AMP23 buffers and outputs the first display gray voltage VG1 that is output from the third mux MUX23.

The first adder 332 adds and outputs the offset gray voltage VOFFS and the second display gray voltage VG2, and the second adder 334 adds an output of the first adder 332 and the first display gray voltage VG1 to output a data voltage Vdata.

By way of summation and review, FIG. 1 is a graph illustrating a general gamma curve. Referring to FIG. 1, in a gamma curve, a ratio of luminance to a grayscale generally has a form of a logarithmic function or an exponential function. Grayscale data that is input to the OLED display by a data signal that is corrected according to a gamma curve and a gray voltage that is applied to a driving transistor of each pixel have a substantially linear relationship.

However, even if a data signal that is corrected according to a gamma curve is used, when a deviation of a threshold voltage Vth occurs between driving transistors, a phenomenon in which a gray voltage of a black level is changed on a pixel basis or on a display panel basis occurs, as shown in offset A of FIG. 1.

In general, when correcting gamma of image data of 8 bits, 256 gray voltages are necessary, but in order to correct a gray voltage of a black level, about 8.5 bits, i.e., gray voltages of 384 or more are necessary. Therefore, there is a problem that the number of signal wires and transistors necessary for embodying gamma increases.

Further, when different gamma curves are applied to each of red, green, blue subpixels or when correction of a gray voltage of a white level is additionally necessary, there is a problem that the number of signal wires and transistors further increases.

However, in accordance with embodiments, by providing offset gamma control data in addition to the display gamma control data, a gray voltage of a black level may be compensated without additional wires and transistors.

In accordance with embodiments, when correcting gamma of a black grayscale, by together reflecting and displaying a threshold voltage difference of each of a plurality of pixels, a luminance difference between a plurality of pixels or a luminance difference between panels can be compensated.

Further, according to embodiments, by separating gamma correction of a black grayscale and gamma correction of grayscales, except for the black grayscale, the number of signal wires and transistors necessary for embodying gamma can be reduced.

Additionally, according to embodiments, by separating a low grayscale segment and a high grayscale segment including a black grayscale and by performing gamma correction thereof, a low grayscale segment in which a visual change is not large can be individually processed.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode (OLED) display, comprising:

a display panel having a plurality of data lines, a plurality of scan lines, and a plurality of pixels, each pixel being connected to a corresponding data line and a corresponding scan line;

a signal controller that generates display gamma control data corresponding to a display grayscale of an image source signal according to previously stored gamma curve information and that generates offset gamma control data corresponding to a position of each of the plurality of pixels according to threshold voltage deviation information;

a scan driver that supplies a plurality of scan signals to the plurality of scan lines; and a data driver that generates a plurality of data signals according to the display gamma control data and the offset gamma control data and that supplies the plurality of data signals to the plurality of data lines, wherein the data driver includes:

an offset gray voltage generator to generate a plurality of offset gray voltages;

a display gray voltage generator to generate a plurality of display gray voltages;

a first selector to select one of the display gray voltages according to the display gamma control data;

a second selector to select one of the offset gray voltages according to the offset gamma control data; and an adder to add the selected display gray voltage and the selected offset gray voltage to generate a data voltage corresponding to one of the data signals.

2. The OLED display as claimed in claim 1, wherein the plurality of offset gray voltages are based on voltage levels in which threshold voltage deviations of respective ones of the plurality of pixels are reflected relative to a gray voltage corresponding to a black grayscale.

3. The OLED display as claimed in claim 2, wherein the data driver comprises:

first and second buffers that buffer outputs of the first and second selectors; wherein the adder outputs the data voltage by adding outputs of the first and second buffers.

4. The OLED display as claimed in claim 3, wherein the data driver comprises an amplifier that amplifies an output of the first selector.

5. The OLED display as claimed in claim 1, wherein the signal controller divides the image source signal into a first image source signal of a high grayscale segment and a second image source signal of a low grayscale segment, and the display gamma control data includes first display gamma control data corresponding to the first image source signal and second display gamma control data corresponding to the second image source signal.

6. The OLED display as claimed in claim 5, wherein the data driver selects one of a plurality of first display gray voltages according to the first display gamma control data, selects one of a plurality of second display gray voltages according to the second display gamma control data, selects one of a plurality of offset gray voltages according to the offset gamma control data, adds the selected second display gray voltage and offset gray voltage, and adds the first display gray voltage to the added second display gray voltage and offset gray voltage to output the data voltage.

7. A method of driving an OLED display including a display panel having a plurality of data lines, a plurality of scan lines, and a plurality of pixels that are connected to a corresponding data line and a corresponding scan line, a scan driver that supplies a plurality of scan signals to the plurality of scan lines, and a data driver that supplies a plurality of data signals to the plurality of data lines, the method comprising:

generating display gamma control data corresponding to a display grayscale of an image source signal according to previously stored gamma curve information;

generating offset gamma control data corresponding to a position of each of the plurality of pixels according to threshold voltage deviation information; and generating the plurality of data signals according to the display gamma control data and the offset gamma control data, wherein generating the data signals includes:

generating a plurality of offset gray voltages using an offset gray voltage generator;

generating a plurality of display gray voltage using a display gray voltage generator;

selecting one of the display gray voltages according to the display gamma control data;

selecting one of the offset gray voltages according to the offset gamma control data; and adding the selected display gray voltage and the selected offset gray voltage to generate a data voltage corresponding to one of the data signals.

8. The method as claimed in claim 7, wherein generating the plurality of data signals comprises generating the plurality of offset voltages so that the plurality of offset gray voltages have a voltage level in which a threshold voltage deviation of each of the plurality of pixels is reflected to a gray voltage corresponding to a black grayscale.

9. The method as claimed in claim 7, wherein generating the plurality of data signals comprises amplifying the selected display gray voltage.

10. The method as claimed in claim 7, wherein generating display gamma control data comprises:

dividing the image source signal into a first image source signal of a high grayscale segment and a second image source signal of a low grayscale segment; and generating first display gamma control data corresponding to the first image source signal and second display gamma control data corresponding to the second image source signal.

11. The method as claimed in claim 10, wherein generating the plurality of data signals comprises:

selecting one of a plurality of first display gray voltages according to the first display gamma control data;

selecting one of a plurality of second display gray voltages according to the second display gray voltage;

selecting one of a plurality of offset gray voltages according to the offset gamma control data and adding the selected second display gray voltage and offset gray voltage; and outputting a data voltage by adding the first display gray voltage to the added second display gray voltage and offset gray voltage.

* * * * *